United States Patent [19]

Balleret

[11] 4,183,774

[45] Jan. 15, 1980

[54] HIGH-ENDURANCE SUPERALLOY FOR USE IN PARTICULAR IN THE NUCLEAR INDUSTRY

[75] Inventor: Alain L. C. Balleret, 14 rue Auguste Neveu, 92500 Rueil-Malmaison, France

[73] Assignees: Commissariat a l'Energie Atomique, Paris, France; Alain L. C. Balleret, Rueil-Malmaison, France

[21] Appl. No.: 784,309

[22] Filed: Apr. 4, 1977

[30] Foreign Application Priority Data

Apr. 2, 1976 [FR] France ..... 76 09626

[51] Int. Cl.[2] ..... C22C 38/44

[52] U.S. Cl. ..... 148/31; 75/122; 75/128 F; 75/128 G; 75/128 Z; 75/128 W; 75/128 V; 75/134 F

[58] Field of Search ..... 75/122, 134 F, 128 F, 75/128 W, 128 G, 128 Z, 128 V; 148/31

[56] References Cited

U.S. PATENT DOCUMENTS

| | | | |
|---|---|---|---|
| 2,432,617 | 12/1947 | Franks et al. | 75/128 F |
| 2,587,613 | 3/1952 | Payson | 75/128 W |
| 3,235,417 | 2/1966 | Roy et al. | 75/128 W |

*Primary Examiner*—R. Dean

*Attorney, Agent, or Firm*—Sughrue, Rothwell, Mion, Zinn and Macpeak

[57] ABSTRACT

The high-endurance alloy essentially contains the following percentages by weight: 0.2 to 1.9% carbon, 18 to 32% chromium, 1.5 to 8% tungsten, 15 to 40% nickel, 6 to 12% molybdenum, 0 to 3% niobium-tantalum, 0 to 2% silicon, 0 to 3% manganese, 0 to 3% zirconium, 0 to 3% vanadium, 0 to 0.9% boron, less than 0.3% cobalt and a quantity of iron such as to ensure overall balance of the alloy.

10 Claims, 7 Drawing Figures

HIGH-ENDURANCE SUPERALLOY FOR USE IN PARTICULAR IN THE NUCLEAR INDUSTRY

This invention relates to high-endurance superalloys based especially on iron, chromium, molybdenum and nickel and containing a maximum of 0.3% cobalt. These superalloys have good mechanical properties over a wide temperature range, good resistance to chemical corrosion in the presence of aggressive media and good resistance to different types of erosion.

Among the alloys which are capable of meeting these practical requirements, high-cobalt alloys are known for their good resistance to chemical corrosion and to erosion but suffer from a disadvantage in that they cannot be employed in a nuclear environment since this cobalt content results in high activation under the influence of neutrons.

Thus in the case of a conventional superalloy having a 60/65% cobalt content such as Alloy No 1 of Table I which has been in extremely widespread use throughout the world for the past 40 years, the cobalt base will be converted under the action of neutrons to cobalt-60; this latter has induced gamma-radiation radioactivity of high energy and has an extremely long half-life (approximately 5 years).

In the case of cobalt, the neutron-absorption cross-section is 37 as measured in barns.

Furthermore, although it is suitable for use in a considerable number of non-nuclear applications, this alloy entails high capital cost by reason of the price of cobalt.

Alloys which are also known contain a high percentage of nickel such as Alloy No 2 of Table 1 which contains approximately 70% nickel. The disadvantage of this alloy, however, is that it does not have good corrosion resistance. This Alloy No 2 which has just been mentioned and is in very common use at the present time has accordingly been tested in contact with demineralized water at 350° C. and, in accordance with expectations, was corroded and formed a green nickel hydroxide film.

Moreover, this alloy contains a high percentage of boron which is not recommended for nuclear applications since boron has a dangerously high neutron-absorption cross-section of 750 barns.

Other known alloys are those which have a base of iron, chromium and molybdenum such as Alloy No 3 of Table 1.

In alloys of this type, the excess quantity of carbon (2.9 to 3.7%) forms chromium carbides in an iron-molybdenum matrix having an extremely high degree of hardness which has good frictional properties in the dry state but remains vulnerable to either hot or corrosive environments since they contain neither cobalt nor nickel.

Furthermore, the low value of elongation (1% maximum) does not readily permit depositions on wearing parts by reason of the shrinkage which results in crack formation at the time of solidification.

Finally, these alloys lack elasticity and elongation to fracture which does not permit logical and satisfactory "shaping" at the time of usual manufacturing processes.

TABLE I

| | (mean figures) | | |
|---|---|---|---|
| | Alloy No 1 | Alloy No 2 | Alloy No 3 |
| Carbon | 1.20 | 1.0 | 2.95 |

TABLE I-continued

| | (mean figures) | | |
|---|---|---|---|
| | Alloy No 1 | Alloy No 2 | Alloy No 3 |
| Chromium | 28 | 20 | 18 |
| Silicon | 1 | 3.5 | 0.85 |
| Manganese | 1 | — | 0.20 |
| Molybdenum | — | — | 16 |
| Niobium-tantalum (alloyed) | — | — | — |
| Tungsten | 4 | — | — |
| Zirconium | — | — | — |
| Nickel | 1.5 | Balance | — |
| Vanadium | — | — | 2 |
| Iron | ≦3 | 5 | Balance |
| Cobalt | 65 | Traces | ≦0.2 |
| Boron | — | 3 | — |
| Elongation | 2% | — | ≦1% |
| Hardness R W C | 40/44 | 45/50 | 66/68 |
| Hardness distribution on test-piece | highly uniform | not uniform | highly uniform |

This invention is precisely directed to a high-endurance superalloy which can be employed especially in a nuclear environment and offers:

a high degree of hardness both in the cold state and in the hot state (300° C.–800° C.) which is either equal to or higher than the known cobalt-base alloys or alloys having a nickel content of over 40%;

resistance to chemical corrosion in all forms which is either equal to or higher than that of known alloys at present in use, especially corrosion resistance in contact with super-heated steam, exhaust gases of engines or gas turbines as well as to the principal corrosive fluids or liquids;

excellent friction behavior in the cold state and in the hot state under different environments or contacts which is either equal to or superior to that of known alloys at present in use. In particular, good resistance and good friction behavior in a nuclear environment or in contact with demineralized water, heavy water or pressurized water, the liquid sodium or vapor employed in nuclear generators, even in the primary circuits;

physical and mechanical characteristics comparable with known alloys at present in use, that is to say: modulus of elasticity, a sufficiently high degree of hot and cold tensile strength, a sufficiently high degree of hardness in the cold state and in the hot state for good shaping of the alloy while at the same time having good friction behavior;

excellent weldability with respect to all structural steels (except in the case of titanium steels or high-chromium and high-carbon steels).

To this end, the high-endurance alloy in accordance with the invention essentially contains the following percentages by weight: 0.2 to 1.9% carbon, 18 to 32% chromium, 1.5 to 8% tungsten, 15 to 40% nickel, 6 to 12% molybdenum, 0 to 3% niobium-tantalum, 0 to 2% silicon, 0 to 3% manganese, 0 to 3% zirconium, 0 to 3% vanadium, 0 to 0.9% boron, less than 0.3% cobalt and a quantity of iron such as to ensure overall balance of said alloy.

In one embodiment of the invention, the high-endurance alloy contains a percentage by weight of 0.2 to 1.9% carbon, 18 to 32% chromium, 1.5 to 8% tungsten, 15 to 40% nickel, 6 to 12% molybdenum, 0.1 to 3% niobium-tantalum, 0.1 to 2% silicon, 0.1 to 3% manganese, 0.1 to 3% zirconium, 0.1 to 3% vanadium, less than 0.3% cobalt and a quantity of iron such as to ensure overall balance of said alloy.

In accordance with a second embodiment of the invention adapted more especially to the case in which the alloy is not intended to be exposed to a neutron flux, said high-endurance alloy carries a percentage by weight of 0.2 to 1.9% carbon, 18 to 32% chromium, 1.5 to 8% tungsten, 15 to 40% nickel, 6 to 12% molybdenum, 0.1 to 3% niobium-tantalum, 0.1 to 2% silicon, 0.1 to 3% manganese, 0.1 to 3% zirconium, 0.1 to 3% vanadium, 0.1 to 0.9% boron, less than 0.3% cobalt and a quantity of iron such as to ensure overall balance of said alloy.

A more complete understanding of the invention will be obtained from the following description which is given by way of explanatory illustration and not in any limiting sense, reference being made to the accompanying drawings, wherein.

Figure 1:
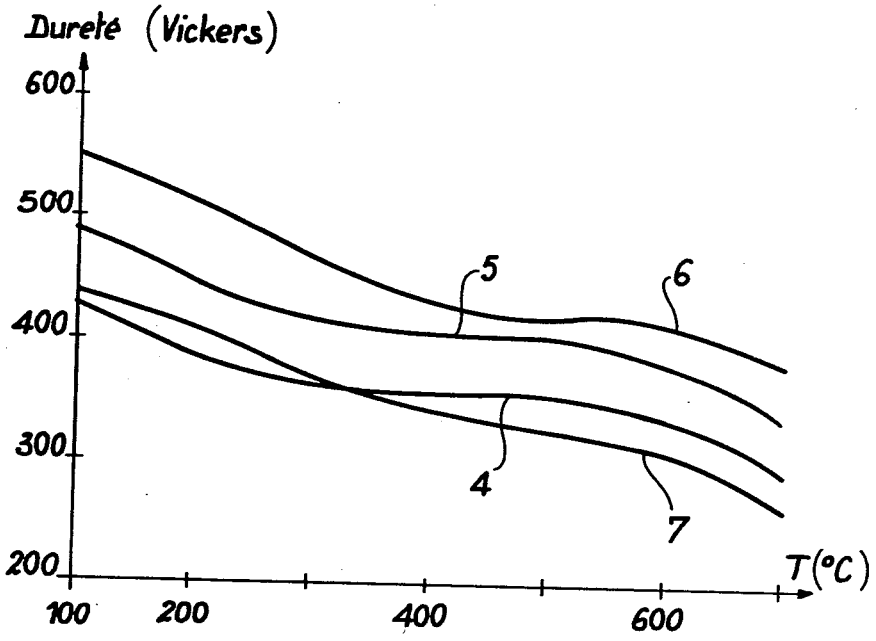
FIG. 1 is a diagram representing the hot-state value of hardness of alloys in accordance with the invention as a function of temperature.

By way of example, there have been grouped together in Table II given hereunder the compositions of three alloys (designated respectively as No 4, 5 and 6) which come within the scope of the present invention, and a cobalt alloy composition (Alloy No 7) which corresponds substantially to that of Alloy No 1 of Table I.

TABLE II

| | Alloy No 4 % | Alloy No 5 % | Alloy No 6 % | By way of comparison Alloy No 7 % |
|---|---|---|---|---|
| Carbon | 0.70 to 1 | 1.20 to 1.50 | 0.20 to 0.50 | 0.9 to 1.20 |
| Chromium | 24 to 28 | 26 to 30 | 27 to 31 | 26 to 30 |
| Silicon | 0.7 to 1.2 | 0.7 to 1.2 | 0.7 to 1.2 | 0.7 to 1.2 |
| Manganese | 0.5 to 1 | 0.5 to 1 | 0.5 to 1 | 0.5 to 1 |
| Molybdenum | 6 to 9 | 6 to 9 | 9 to 12 | — |
| Vanadium | 0.5 to 1 | 1 to 2 | 1 to 2 | — |
| Niobium-Tantalum | 0.5 to 1 | 0.5 to 1 | 0.5 to 1 | — |
| Tungsten | 3 to 5 | 3 to 5 | 1.5 to 3 | 3 to 5 |
| Zirconium | 0.5 to 1 | 0.5 to 1 | 0.5 to 1 | — |
| Nickel | 32 to 36 | 26 to 30 | 16 to 20 | 1 to 1.5 |
| Cobalt | ≦0.3 | ≦0.3 | ≦0.3 | 60 to 65 |
| Iron | Balance | Balance | Balance | ≦3 |
| Boron | ≦0.5 | ≦0.5 | — | — |

In the alloys in accordance with the invention, the three base elements are:

chromium,
nickel,
iron.

The base equilibrium diagram is that of the nickel-chromium-iron system which varies according to the relative proportions of these three elements.

As a general rule, these alloys are in the $\gamma+\alpha$ phase. The $\sigma$ phase appears only sporadically and according to the ratios of iron+chromium.

These alloys crystallize in the compact hexagonal system. Within the range of percentage contents of these three elements as mentioned above, it is possible to orient the desirable phases and to avoid the presence of the $\sigma$ phase alone, the matrix of which is fragile.

In certain combinations, it is possible to obtain the phase $\alpha+\sigma$. The typical example is the Alloy No 6 which is placed at $\alpha+\sigma$ and is outstanding in the case of applications of castings to problems of friction arising both in the hot state and in the cold state under particularly difficult conditions.

The position of the boundary of the two phases $(\gamma+\alpha)$ is in turn dependent on the rate of cooling.

In fact, the allotropic transformation of the corresponding alloys is subject to high thermal hysteresis. The change of state $\gamma \rightarrow \alpha$ is never complete in spite of heat treatments with slow reductions in temperature.

It is meant in the foregoing that, in these phases, the alloys produced have practically no transformation points (except for Alloy No 6 which has a transformation point at 785° C. in the $\alpha+\sigma$ phases) and that rapid or slow cooling has little influence on their characteristics.

If Alloy No 7 (high cobalt content) is compared with Alloys No 4 and 5, the same physical reactions are found both in regard to rapid cooling and in regard to slow cooling.

The alloys in accordance with the invention also contain 6 to 12% molybdenum and 1.5 to 8% tungsten. These precise proportions of Mo and W make it possible to limit the resultant weight content of metallic carbides in order to avoid the presence of excessively carburized zones in matrices which already have a high value of hardness.

Other elements such as vanadium, zirconium, silicon, manganese, niobium-tantalum and boron can also be present in the alloys in accordance with the invention.

Vanadium in proportions within the range of 0.1 to 3% by weight has a marked influence on the formation of ferrite and also performs an effective function in the formation of carbides. In order to ensure the function thus mentioned, vanadium is incorporated with fully austenitic stainless alloys (high nickel content with or without manganese) by reason of by fact that it promotes a favorable ageing process which justifies its use in applications involving high temperatures within the range of 400° to 800° C. over long periods of time.

Furthermore, in the final transformation phase, extremely fine vanadium carbides of very high hardness are found to be present in the alloy and uniformly distributed in the mass.

Finally, a process of secondary hardening takes place in vanadium alloys and results from precipitation of V4 C3 on the dislocations.

The precipitates which are nucleated within the matrix in a homogeneous manner also has a hardening influence in the case of sufficiently high vanadium and carbon contents.

Moreover, in the case of the vanadium and carbon contents aforesaid, it appears that locking of the grain boundaries is ensured by precipitation of the vanadium carbides and not by the precipitation of cementite.

In concentrations of 0.1 to 3% by weight, zirconium permits an appreciable reduction in the proportions of gases and of sulphur in the alloys by removal of the nitrogen content. At the time of casting, zirconium performs the function of deoxidant.

A further advantage of zirconium lies in the fact that it permits neutron economy by reason of its very low absorption cross-section.

In concentrations of 0.1 to 3% by weight, niobium-tantalum (alloyed) performs a preponderant function by permitting carbide stabilization, grain refinement and reduction of intergranular corrosion. An improvement is also achieved in high-temperature properties (at 400° to 800° C.) and in welding conditions. As a result of formation of niobium carbides, a further improvement is achieved in the creep properties of superalloys which contain a fairly high proportion of nickel.

In concentrations of 0.1 to 2% by weight, silicon improves the corrosion resistance of the alloy in certain acid solutions which have a reducing action.

It is also worthy of note that silicon performs the favorable action of deoxidant both prior to and during the casting process.

In concentrations of 0.1 to 2%, manganese has an influence which is similar to that of nickel, especially in regard to its tendency to stabilize austenite. The presence of manganese also improves the possibility of mechanical working or rolling of alloys in the hot state.

An additional property lies in the fact that manganese reduces fissility, especially when carrying out welding processes or depositions of alloys having high values of hardness.

During production of the alloy, manganese performs the function of deoxidant.

In concentrations of 0.1 to 0.9% by weight, boron can be employed as a melting agent within the mass since it has the effect of reducing the melting point of the alloy. This property is an advantage in the case of "strips for recharging wearing parts" or spray-coating powders.

Alloys which fall within this range of compositions can normally be produced by all known methods of melting. For example, they can be produced in an induction furnace or in a vacuum-arc furnace.

Said alloys can be cast by all methods adopted in conventional foundry practice and especially in sand or metal chill-molds, by the lost-wax process, by direct casting, by centrifugation and so forth. These alloys are suitable for the fabrication of solid parts of either small or large size without any potential danger of crack-formation or of abnormal segregations.

The alloys in accordance with the invention are endowed with good mechanical properties. In particular, the ductility in the hot state and cold state is comparable with that of the best cobalt-base alloys. Thus in the range of compositions which is contemplated, the elongation at fracture of the alloys varies from 1.5 to 3%. The value of hardness which is high in the cold state is relatively high in the hot state; tensile strength is as high in the hot state as in the cold state.

Reference being made to FIG. 1 which gives the hot-state Vickers hardness values of Alloys No 4, 5, 6 and 7 as a function of temperature (in °C.), it is apparent that the values of hardness of Alloys No 5 and 6 are higher and that the hot-state hardness of Alloy No 4 is also higher when the temperature is higher than 300° C. It is worthy of note in connection with the hardness of the alloys in accordance with the invention that Alloys No 4 and 5 exhibit normal reaction ( as is the case with the cobalt alloy No 7) to the increase in carbon content, namely to an increase in the mass of metal carbides. As a consequence, there is thus obtained an increasing degree of hardness proportionally to the carbon content, this being evidently accompanied by an increase in size of the texture which is liable to become crystalline if the proportions of carbon-chromium are too high.

On the other hand, in the compositions corresponding to Alloy No 6, the hardness does not increase with the carbon content. In fact, in this composition which is derived from the $\alpha+\sigma$ phase, it is apparent that the carbon curve is reversed with respect to that of other known superalloys.

Thus the curve which extends from C=1% to C=0.20% corresponds to a texture which becomes progressively finer whereas the hardness increases progressively as the carbon decreases. The best level stage or plateau is located between 0.20% of C and 0.50% of C since the alloy obtained is hard in the cold state, hard in the hot state, highly corrosion-resistant and sufficiently ductile to permit of either casting or shaping.

In consequence, Alloy No 6 proves to be of considerable interest. However, in the case of recharging with so-called "hard redeposits", the use of this alloy cannot be recommended since the dilution with the base steels disturbs its equilibrium diagram. In this application, it is therefore preferable to select from the range of alloys in accordance with the invention those which have a higher nickel content and a lower iron content, namely alloys which are suitable for all "redeposits" by means of known methods without any subsequent heat treatment.

Table III indicates the results of physico-mechanical tests performed on Alloys No 4, 5 and 6. The values given in this table represent the mean value obtained in respect of different alloys which come within the range of composition of Alloys No 4, 5 and 6. By way of comparison, the table also gives the results obtained in the case of the cobalt-base Alloy No 7.

TABLE III

| | ROOM TEMPERATURE | | | | | TEMPERATURE 600° C. | |
|---|---|---|---|---|---|---|---|
| Grade | Modulus of elasticity | Ultimate tensile strength | R.W.C. hardness | Elongation | Density | High temperature tensile strength | Elongation |
| Alloy No 4 | E = da N/mm² 22,100 ± 300 | R = da N/mm² 61 ± 3 | 38/42 | A % 2/2.2 | 7.9 | R = da N/mm² 53 ± 3 | A % 2/3 |
| Alloy No 5 | 24,800 ± 250 | 57 ± 3 | 42/46 | 1.8/2 | 8.3 | 50 ± 3 | 1.8/2.2 |
| Alloy No 6 | 19,550 ± 250 | 57 ± 3 | 46/50 | 1.8/2 | 7.7 | 48 ± 3 | 1.7/2.1 |
| Alloy No 7 (Cobalt) | 22,800 ± 350 | 79 ± 3 | 40/44 | 2/2.2 | 8.4 | 69 ± 3 | 3 |
| | Tests performed on LE ROLLAND-SORIN pendular | | | | | Tests performed on CHEVENARD microtraction machine | |

TABLE III-continued

| Grade | ROOM TEMPERATURE | | | | | TEMPERATURE 600° C. | |
|---|---|---|---|---|---|---|---|
| | Modulus of elasticity | Ultimate tensile strength | R.W.C. hardness | Elongation | Density | High temperature tensile strength | Elongation |
| | elasticimeter | | | | | | |

Table IV indicates the mean coefficients of expansion of Alloys No 4, 5, 6 and 7 at various temperatures. This coefficient of expansion is defined by :

$$\alpha \text{ (mean)} = \frac{\Delta 1}{1^\circ} \times \frac{1}{\theta - \theta_o}$$

$1^\circ$ = length at room temperature
$\Delta 1$ = variation in length
$\theta$ = temperature
$\theta_o$ = room temperature, namely 20° C. in the case of the tests performed
$\alpha$ is expressed in microns per meter per °C. ($\mu$/m×°C.)

TABLE IV

| | Alloy No 4 | Alloy No 5 | Alloy No 6 | By way of comparison Alloy No 7 |
|---|---|---|---|---|
| 20° to 100° C. | 8.3 | 7.5 | 7.85 | 11.8 |
| 200° C. | 8.5 | 8.5 | 8.65 | 12.8 |
| 300° C. | 8.7 | 9.0 | 9.10 | 14.00 |
| 400° C. | 9.0 | 10 | 9.55 | 15 |
| 500° C. | 9.30 | 11.40 | 9.80 | 15.5 |
| 600° C. | 9.58 | 12.45 | 10.20 | 16 |
| 700° C. | 9.85 | 13.05 | 10.50 | 16.1 |
| 800° C. | 10.15 | 13.55 | 10.50 | 16.2 |

The coefficient of friction of the alloys in accordance with the invention is excellent in a very wide range of different media such as, for example, in dry air, in helium, in liquid sodium and in a vacuum.

Table V gives the results of friction tests carried out on Alloys No 4, 5, 6 and 7.

These tests have been performed on a:
Moulin alternating frictiograph
contact: flat/flat
alternating motion—stroke 30 mm
speed: 0.5 mm/s
load: 11 kgf
pressure: 1.3 bar
temperature: approx. 150° C.

In this table:
fo represents the coefficient of friction (initial coefficient)
fm represents the coefficient of friction (mean coefficient)
ff represents the coefficient of friction (on completion of testing)
$\Delta p$ represents the weight loss of the track
$\Delta pe$ represents the weight loss of the test specimen.

TABLE V

| Test specimens Track | Test specimens Specimen | Coefficient of friction | Amplitude of vibration | Weight loss of test specimens | Temperature | Observations |
|---|---|---|---|---|---|---|
| Alloy No 4 | Alloy No 4 | fo = 0.160<br>fm = Ω 0.150 | ±0.025 | $\Delta P_p$ = 0.0008<br>$\Delta P_e$ = 0.0003 | 150° C. | Smooth and uniform friction |
| Alloy No 4 | Alloy No 5 | fo = 0.175<br>fm = 0.200 | ±0.025 | $\Delta P_p$ = 0.0003<br>$\Delta P_e$ 32 0.0001 | 150° C. | " |
| Alloy No 5 | Alloy No 5 | fo = 0.180<br>fm = 0.175 | ±0.025 | $\Delta P_p$ = 0.0002<br>$\Delta P_e$ = 0.0001 | 150° C. | " |
| Alloy No 7 Comparative | Alloy No 7 | fo = 0.185<br>fm = 0.200 | ±0.025 | $\Delta P_p$ = 0.0003<br>$\Delta P_e$ = 0.0001 | 150° C. | " |

Figure 2:
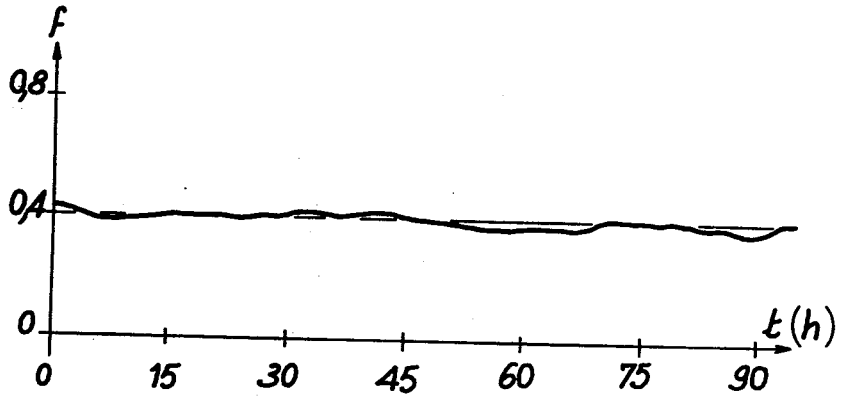
FIG. 2 is a diagram which illustrates friction tests carried out on alloys in accordance with the invention.

Referring now to FIG. 2, it is apparent that the mean friction of Alloys No 4 and 5 in liquid sodium at 600° C. at a pressure of 3.4 bar at a rate of 1.3 cm/s results in a very slight sine-wave which is close to a straight line. This friction is of slight and uniform value. Thus the results obtained are comparable with those obtained in the case of Co alloys (Alloy No 7).

Moreover, the alloys in accordance with the invention have good corrosion resistance over long periods of time in the presence of aggressive media.

Thus three test specimens each corresponding to Alloys No 4, 5 and 6 have been subjected to corrosion in demineralized and degassed water at 350° C. for a period of 3 months.

Weighing operations were performed each month.

After one month of testing, a mean weight increase of 30 mg/dm$^2$ was noted in the case of all the test specimens and this value remained unchanged until the test was completed.

A study of micrographic sections of corroded test specimens revealed a very thin and uniform oxide film.

The corrosion resistance of the tested high-endurance Alloys No 4, 5 and 6 therefore appears satisfactory in the demineralized and degassed water at 350° C.

In another test, the cobalt-base Alloy No 7 has produced substantially equivalent results.

Moreover, corrosion tests in an acid medium have produced good results. Thus Table VI illustrates the results obtained in the case of Alloys No 4, 5, 6 and 7 after these alloys have been exposed during an 8-day period to the vapors of 850 cm$^3$ of a 12 N nitric-acid solution and of 150 cm$^3$ of 36 N sulphuric acid containing 13 g of oxalic acid.

TABLE VI

| TEST SPECIMEN | INITIAL WEIGHT | AFTER | % LOSS | OBSERVATIONS |
|---|---|---|---|---|
| Alloy No 4 | 1,5045 | 1,0836 | 28% | without cobalt |
| Alloy No 5 | 1,8195 | 1,3223 | 27.3% | without cobalt |
| Alloy No 6 | 2,2075 | 1,6380 | 25.8% | without cobalt |
| Alloy No 7 Comparative | 1,8759 | Disintegrated | — | 65% cobalt |

There can be no possible doubt whatever that the alloys in accordance with the invention offer good resistance to certain acids and to aqueous corrosion even in the hot state.

Alloys which have a high cobalt content do not exhibit the same degree of corrosion resistance. It is thus apparent that nickel is a more favorable element than cobalt for the purpose of endowing alloys with resistance to chemical agents as a whole.

In sodium at 600° C., no attack is observed and the same applies in carbon monoxide at 500° C. as well as in carbon dioxide at 500° C.

A metallographic study of the alloys in accordance with the invention has been carried out by optical and electronic microscopy as well as by anodic dissolution and X-ray identification which reveals that their structure is formed of a ferritico-austenitic matrix reinforced by a high proportion of solid eutetic carbides of the M7 C3 type.

Furthermore, there takes place during the cooling process a precipitation of complex cellular carbides of the form M6C which contribute to an improvement in both mechanical and physical properties.

Figure 3:
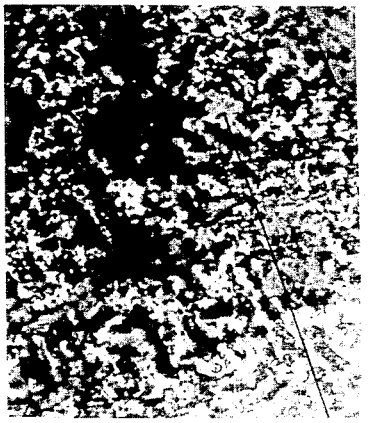
FIGS. 3 to 6 are microphotographs which illustrate the structure of the alloys in accordance with the invention.
Figure 4:
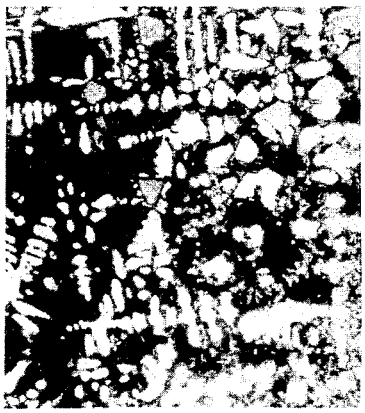

As can be seen from FIGS. 3 and 4 which illustrate respectively the structure of Alloy No 4 with a magnification of 600 X, and Alloy No 6 with a magnification of 600 X, the typical morphology of the eutectic carbides M7 C3 is represented by a dense lattice identified by X-ray diffraction.

Moreover, the increased number of dislocations at the interface between matrix and cellular carbides is also responsible for the increased resistance of these alloys.

The alloys in accordance with the invention have a high density of complex metallic carbides bonded together by means of flexible boundaries without any residual austenite and therefore having a low degree of fragility, thereby permitting distribution of the crystals in the form of a homogeneous texture within a stable matrix which is little affected by temperature effects or chemical agents. This mass of judiciously distributed carbides permits frictional contacts of very high quality.

By virtue of the concentrations of iron and of nickel, these alloys have a ferritico-austenitic matrix which has a fairly high degree of hardness without being fragile in order to prevent seizure and to support a mass of carbides which remain of small size and are perfectly embedded in this latter.

In these alloys, high ratios are obtained between the hardness of the carbides and that of the matrix, which accordingly promotes good friction.

The ductility of the matrix permits a certain deformation rate in the case of local overstresses, thus distributing the load whilst the carbide support structure ensures rigidity and limits wear.

By way of example, there are given below in Table VII the values of hardness of the matrix and the carbides as indicated in $DaN/mm^2$ in 100 gr and the ratio of these values of hardness in the case of Alloys No 4, 6 and 7.

TABLE VII

| Alloy | Matrix | Carbides | Carbides/matrix hardness ratio |
|---|---|---|---|
| No 4 | 310 | 701 | 2.3 |
| No 6 | 340 | 973 | 2.8 |
| No 7 Cobalt | 621 | 805 | 1.3 |

Figure 7:
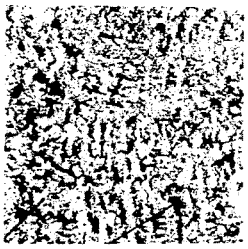
FIG. 7 is a microphotograph which illustrates by way of comparison the structure of the No 7 cobalt alloy of Table II.
Figure 5:
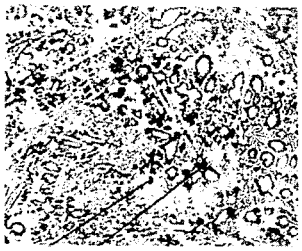
Figure 6:
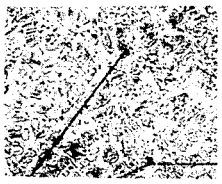

FIGS. 5, 6 and 7 illustrate respectively with a magnification of 100 X the structures which correspond to Alloys No 4, 6 and 7.

As a result of their good properties, these alloys find a large number of applications in many cases of mechanics, physics or applied chemistry, especially in problems of dry friction in a vacuum, in the cold state or at moderately high temperatures: (300° to 800° C.). By reason of their low cobalt content (less than 0.3%), they can be employed in the presence of neutrons since they are not liable to undergo hazardous activation. Moreover, when they do not contain boron, these alloys have a relatively low neutron-absorption capacity and can be employed to advantage in the fabrication of components for primary circuits of nuclear reactors, for example in the construction of pumps, valves, packing-rings, ball-bearings or roller-bearings or generally speaking for all parts in which there is a potential danger of wear by erosion, by friction, by corrosion or a potential danger of seizure.

It should be noted in addition that tests carried out at −170° C. have shown that the structure of these alloys does not undergo any alteration and that these latter remain homogeneous.

The alloys mentioned above are therefore suitable for the fabrication of parts such as discharge valves, control valves, ball-bearings and so forth.

In the case of low temperatures, interesting tests have been carried out on satellites and therefore in a sidereal vacuum (approximately −80° C.). The components were shafts, small pinions and ball-bearings of small size.

These alloys can also be employed in the form of "strips" in order to recharge wearing parts by means of the usual methods: oxyacetylene torch or argon arc.

Similarly, it is possible to employ them in the form of powders in order to form additions at certain points of parts and to protect these latter against wear by spray-coating with Schooping guns or plasma-arc torches.

Furthermore, the alloys can find a large number of applications, especially in industries in which it is sought to achieve friction without seizure at temperatures attaining 400° to 800° C.

Finally, in cryogenics, tests carried out at −172° C. have proved that the good friction achieved makes it possible to contemplate the construction of shafts, ball-bearings or roller-bearings without any difficulty and even without lubrication.

In a sidereal vacuum simulator for testing ball-bearings for artificial satellites, the results have proved that the alloys in accordance with the invention permit elimination of "sticking" which usually occurs in the case of bearings constituted by alloys containing cobalt or a very high percentage of nickel (over 40%).

What we claim is:

1. A high-endurance alloy which illustrates a high degree of hardness both in the cold state and in the hot state, resistance to chemical corrosion and excellent friction behavior in the cold state and in the hot state, which alloy comprises carbides of the M7 C3 and M6 C type, which consists essentially of by weight 0.2 to 1.9% carbon, 18 to 32% chromium, 1.5 to 8% tungsten, 15 to 40% nickel, 6 to 12% molybdenum, 0.1 to 3% niobium-tantalum, 0.1 to 2% silicon, 0.1 to 3% manganese, 0.1 to 3% zirconium, 0.1 to 3% vanadium, less than 0.3% cobalt and a quantity of iron such as to ensure overall balance of said alloy.

2. A high-endurance alloy which illustrates a high degree of hardness both in the cold state and in the hot state, resistance to chemical corrosion and excellent friction behavior in the cold state and in the hot state, which alloy comprises carbides of the M7 C3 and M6 C type, which consists essentially of by weight 0.2 to 1.9% carbon, 18 to 32% chromium, 1.5 to 8% tungsten, 15 to 40% nickel, 6 to 12% molybdenum, 0.1 to 3% niobium-tantlum, 0.1 to 2% silicon, 0.1 to 3% manganese, 0.1 to 3% zirconium, 0.1 to 3% vandium, 0.1 to 0.9% boron, less than 0.3% cobalt and a quantity of iron such as to ensure overall balance of said alloy.

3. A high-endurance alloy according to claim 2, wherein said alloy consists essentially of by weight 0.70 to 1% carbon, 24 to 28% chromium, 0.7 to 1.2% silicon, 0.5 to 1% manganese, 6 to 9% molybdenum, 0.5 to 1% vanadium, 0.5 to 1% niobium-tantalum, 3 to 5% tungsten, 0.5 to 1% zirconium, 32 to 36% nickel, less than 0.5% boron, less than 0.3% cobalt and a quantity of iron such as to ensure overall balance of said alloy.

4. A high-endurance alloy according to claim 2, wherein said alloy consists essentially of by weight 1.20 to 1.50% carbon, 26 to 30% chromium, 3 to 5% tungsten, 26 to 30% nickel, 6 to 9% molybdenum, 0.5 to 1% niobium-tantalum, 0.7 to 1.2% silicon, 0.5 to 1% manganese, 0.5 to 1% zirconium, 1 to 2% vanadium, less than 0.3% cobalt, less than 0.5% boron and a quantity of iron such as to ensure overall balance of said alloy.

5. A high-endurance alloy according to claim 1, wherein said alloy consists essentially of by weight 0.20 to 0.50% carbon, 27 to 31% chromium, 1.5 to 3% tungsten, 16 to 20% nickel, 9 to 12% molybdenum, 0.5 to 1% niobium-tantalum, 0.7 to 1.2% silicon, 0.5 to 1% manganese, 0.5 to 1% zirconium, 1 to 2% vanadium, less than 0.3% cobalt and a quantity of iron such as to ensure overall balance of said alloy.

6. A high-endurance alloy according to claim 1, wherein said alloy has a ferritico-austenitic matrix.

7. A high-endurance alloy according to claim 2, wherein said alloy has a ferritico-austenitic matrix.

8. A high-endurance alloy according to claim 3, wherein said alloy has a ferritico-austenitic matrix.

9. A high-endurance alloy according to claim 4, wherein said alloy has a ferritico-austenitic matrix.

10. A high-endurance alloy according to claim 5, wherein said alloy has a ferritico-austenitic matrix.

* * * * *